US007035579B2

(12) United States Patent
Lee

(10) Patent No.: US 7,035,579 B2
(45) Date of Patent: Apr. 25, 2006

(54) SHEET SEPARATING APPARATUS FOR A FUSING UNIT AND METHOD FOR USING THE SAME

(75) Inventor: Bong-hee Lee, Suwon (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 8 days.

(21) Appl. No.: 10/673,244

(22) Filed: Sep. 30, 2003

(65) Prior Publication Data

US 2004/0146322 A1 Jul. 29, 2004

(30) Foreign Application Priority Data

Jan. 27, 2003 (KR) ..... 10-2003-0005360

(51) Int. Cl.
*G03G 15/20* (2006.01)

(52) U.S. Cl. ..... 399/323

(58) Field of Classification Search ..... 399/323, 399/398, 399; 271/307, 311, 900; 219/216
See application file for complete search history.

(56) References Cited

U.S. PATENT DOCUMENTS

| | | | | |
|---|---|---|---|---|
| 3,938,950 | A * | 2/1976 | Weiler et al. | 432/59 |
| 4,065,120 | A * | 12/1977 | Imaizumi et al. | 271/311 |
| 4,771,310 | A * | 9/1988 | Leo et al. | 399/323 |
| 5,532,810 | A * | 7/1996 | Cahill | 399/323 |
| 6,456,817 | B1 * | 9/2002 | Kamiya | 399/323 |

* cited by examiner

*Primary Examiner*—Robert Beatty
(74) *Attorney, Agent, or Firm*—Roylance Abrams Berdo & Goodman LLP

(57) ABSTRACT

A sheet separating apparatus for a fusing unit separates a sheet being conveyed through a fusing unit from a heating roller and guides the sheet to a discharging roller without causing damages to a surface of a fusing roller. The sheet separating apparatus comprises a separating claw rotatably disposed toward a discharging side of a heating roller, for separating a sheet from the heating roller, and a contact spring pivoting the separating claw so that a front end of the separating claw is in contact with the heating roller with a predetermined constant pressure. The front end of the separating claw has rounded corners. It is preferred that the front end of the separating claw is chamfered. Also, it is preferred that the separating claw is made of stainless steel.

8 Claims, 4 Drawing Sheets

SHEET SEPARATING APPARATUS FOR A FUSING UNIT AND METHOD FOR USING THE SAME

This application claims the benefit under 35 U.S.C. §119 (a) of Korean Application No. 2003-05360, filed Jan. 27, 2003, in the Korean Intellectual Property Office, the disclosure of which is incorporated herein by reference in its entirety.

BACKGROUND OF THE INVENTION

1. Field of the Invention

The present invention relates to a fusing unit of an electrophotographic image forming apparatus, and more particularly, to a sheet separating apparatus for a fusing unit which is to separate a sheet of paper being conveyed through a fusing unit from a heating roller and guides the sheet to a discharging roller.

2. Description of the Related Art

An electrophotographic image forming apparatus transfers an image formed on a photosensitive medium to a sheet of printing paper and fuses the transferred image onto the sheet by using heat and pressure from a fusing unit. The fusing unit has a heating roller generating heat and a pressing roller applying pressure to the sheet, both of which are rotatably disposed opposing each other. The transferred image is fused onto the sheet while passing between the heating roller and the pressing roller. After that, the image-fused sheet is discharged out of the image forming apparatus by a discharging roller.

However, when the image is fused onto the sheet passing through the fusing unit, the sheet is inclined to roll toward the heating roller by the influence of the heated toner that is used to form the transferred image. Accordingly, there is a concern that the fused sheet may not be discharged out of the image forming apparatus by the discharging roller and instead may become jammed between the heating roller and the frame.

In order to prevent this problem, a sheet separating apparatus for a fusing unit is required, which separates a sheet being conveyed through the fusing unit and rolled toward the heating roller from the heating roller and conveys the sheet to the discharging roller. FIG. 1 shows an example of a fusing unit of an electrophotographic image forming apparatus employing such a sheet separating apparatus.

Referring to FIG. 1, a fusing unit includes a frame 11, a sheet guide 13, a heating roller 15, a pressing roller 16, and a sheet separating apparatus 30.

The sheet guide 13 guides a sheet of printing paper 10 being conveyed from a developing unit (not shown) with an image being transferred to an upside surface of the sheet 10 between the pressing roller 16 and the heating roller 15.

The heating roller 15 is rotatably disposed in the frame 11, generates the heat necessary to fuse the transferred image onto the sheet 10 and also supports the sheet 10 as it is pressed by the pressing roller 16. The pressing roller 16, which is used to fuse the transferred image onto the sheet 10 together with the heating roller 15, is disposed in the frame 11 to press the sheet 10 against the heating roller 15 with a predetermined constant pressure.

The sheet separating unit 30 includes a separating claw 31 and a contact spring 36. The separating claw 31 is disposed toward a paper discharging side of the heating roller 15 to separate the sheet conveyed through the fusing unit 12 from the heating roller 15. At this time, the separating claw 31 is pivotably assembled with a hinge 34 secured to the frame 11 and has a front end 32 constantly in contact with a surface of the heating roller 15. At this point, the front end 32 is sharpened as much as possible so as not to form a gap between the front end 32 and the contacting surface of the heating roller 15 (see FIG. 2). Also, the separating claw 31 has to be made of a synthetic resin or other suitable material having a heat resisting property since it is constantly in contact with the heating roller 15 which is at a high temperature. The contact spring 36 presses the separating claw 31 so that the front end 32 of the separating claw 31 is constantly in contact with the surface of the heating roller 15. One end of the contact spring 36 is secured to the frame 11 and the other end is connected to the other end 35 of the separating claw 31. Accordingly, the separating claw 31 is pivoted on the hinge 34 toward the heating roller 15 so that the front end 32 of the separating claw 32 keeps pressing the surface of the heating roller 15 with a predetermined constant pressure.

A sheet discharging guide 20 is disposed in the frame 11 between a pair of discharging rollers 22, 23 and the heating roller 15, for guiding the sheet 10 separated by the sheet separating apparatus 30 to the pair of discharging rollers 22, 23.

Hereinafter, operation of the conventional sheet separating unit for the fusing unit will be described.

The sheet 10 being conveyed from the developing unit (not shown) with the image transferred thereto is guided by the sheet guide 13 and enters into the space between the heating roller 15 and the pressing roller 16. As the sheet 10 passes between the heating roller 15 and the pressing roller 16, the transferred image is fused onto the sheet 10. The sheet 10 passes between the heating roller 15 and the pressing roller 16, and rolls up along the heating roller 15 due to the characteristics of the toner used to form the image and the heat applied thereto. A front periphery of the sheet 10 being conveyed along the heating roller 15 is separated from the heating roller 15 by the front end 32 of the separating claw 31 and is conveyed along the sheet discharging guide 20. The printing sheet 10 being conveyed along the sheet discharging guide 20 is discharged out of the image forming apparatus by the pair of discharging rollers 22, 23. That is, the sheet 10 passing between the heating roller 15 and the pressing roller 16 and stuck to the heating roller 15 is separated from the heating roller 15 by the sheet separating apparatus 30 and discharged out of the image forming apparatus by the pair of the discharging rollers 22, 23.

However, when the sheet separating apparatus 30 is installed, or when a sheet of paper 10 is jammed between the separating claw 31 and the heating roller 15 and removed, it is often the case that corners of the sharpened front end 32 of the separating claw 31 cause damage to the surface of the heating roller 15.

Also, it is required to sharpen the front end 32 of the separating claw 31 as much as possible, but the method for fabricating the separating claw 31 by injection-molding of the synthetic resin makes it difficult to sufficiently sharpen the front end 32 of the separating claw 31. Accordingly, in order to solve this problem, a method has been suggested that is to separately fabricate the front end 32 and attach the front end to the separating claw 31. In that case, however, there is a problem of increased fabrication cost.

Accordingly, there is a recognized need to develop a sheet separating device for a fusing unit capable of preventing damage to the heating roller and a method of easily fabricating the sharpened front end, thereby preventing fabrication costs from being increased.

SUMMARY OF THE INVENTION

The present invention has been developed in order to solve the above problems in the prior art. Accordingly, it is an aspect of the present invention to provide a sheet separating apparatus for a fusing unit capable of preventing damage to the surface of a heating roller when the sheet separating apparatus is installed or a jammed sheet is removed. Another aspect of the invention is to provide a method of easily fabricating a shapened front end of a separating claw.

The above aspects are achieved by providing a sheet separating apparatus for a fusing unit comprising a separating claw rotatably disposed toward a discharging side of a heating roller, for separating a sheet from the heating roller, and a contact spring pivoting the separating claw so that a front end of the separating claw is in contact with the heating roller with a predetermined constant or substantially constant pressure. The front end of the separating claw has rounded corners.

It is preferred that the front end of the separating claw is chamfered.

Also, it is preferred that the separating claw is made of metallic material, and more preferably, the separating claw is made of stainless steel.

Also, it is preferred that the separating claw is formed by a press.

Accordingly, the sheet separating apparatus for the fusing unit according to an embodiment of the present invention is capable of preventing damage to a surface of the heating roller when the sheet separating apparatus is installed or a jammed sheet is removed. Also, the sheet separating apparatus according to an embodiment of the present invention enables easily fabricating the front end of the separating claw.

BRIEF DESCRIPTION OF THE DRAWINGS

The above aspects and other advantages of the present invention will be more apparent by describing an exemplary embodiment of the present invention with reference to the accompanying drawing figures, in which.

In the drawing figures, it will be understood that like reference numerals refer to like features and structures.

DETAILED DESCRIPTION OF THE PREFERRED EMBODIMENT

Figure 1:
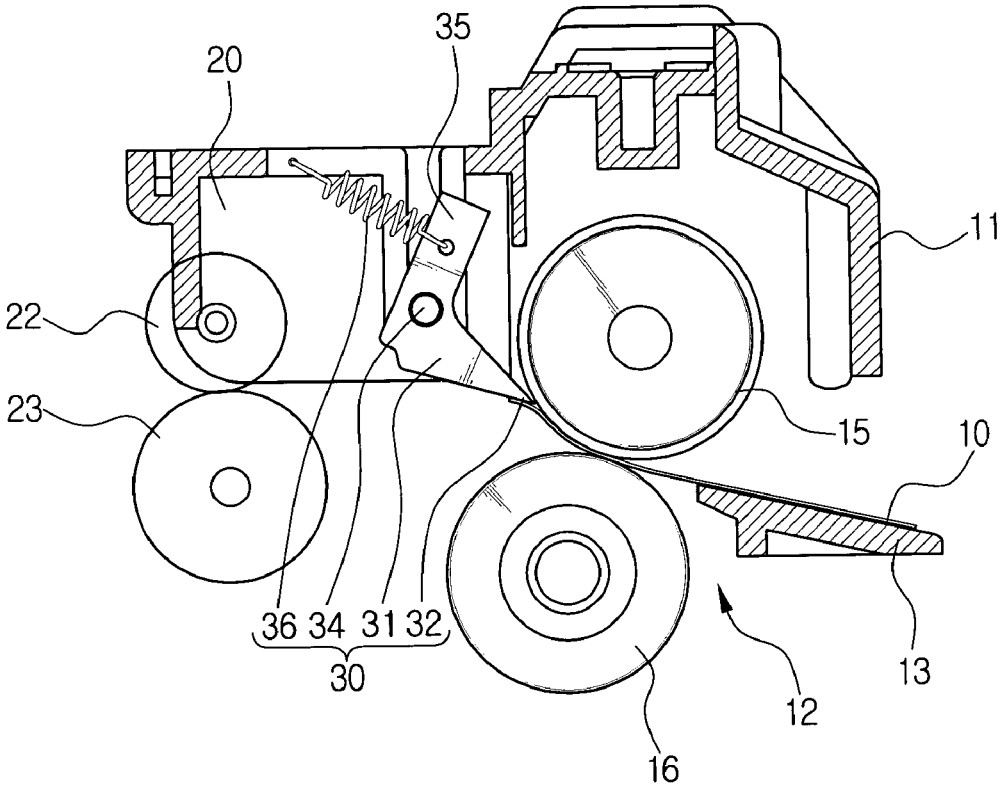
FIG. 1 (PRIOR ART)
FIG. 1 is a cross sectional view showing a fusing unit employing a conventional sheet separating apparatus.

Hereinafter, an exemplary embodiment of the present invention will be described in greater detail with reference to the accompanying drawing figures. With respect to parts identical to those of the conventional apparatus discussed above, like reference numerals are assigned.

Figure 3:
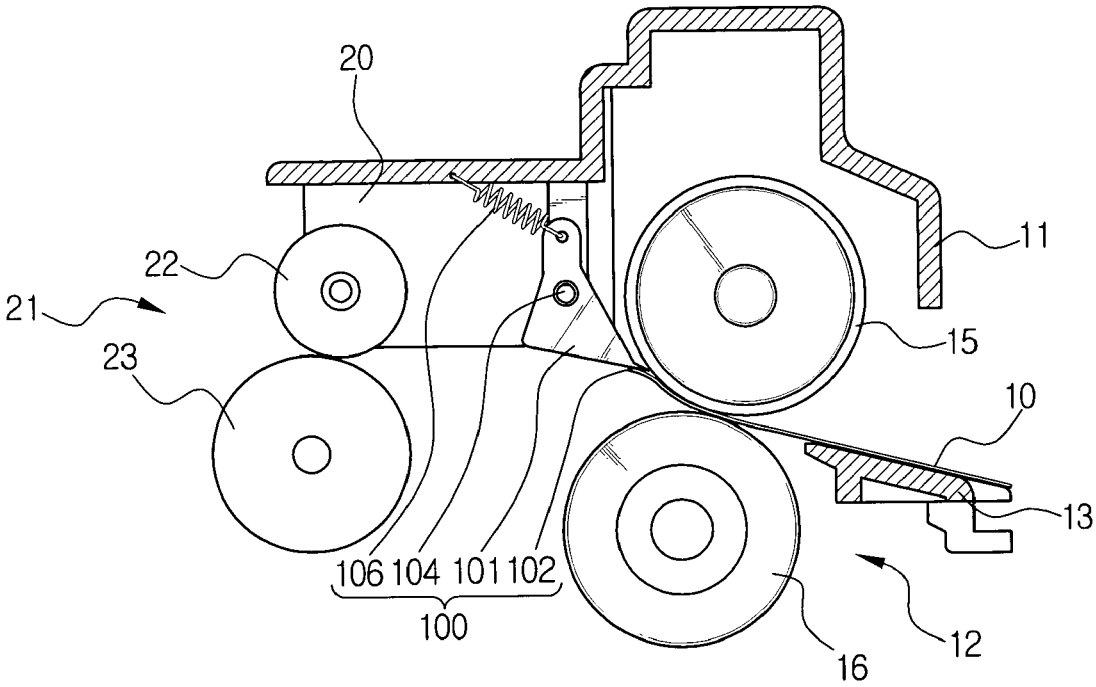
FIG. 3 is a cross sectional view showing a fusing unit employing a sheet separating apparatus according to an embodiment of the present invention.
Figure 4:
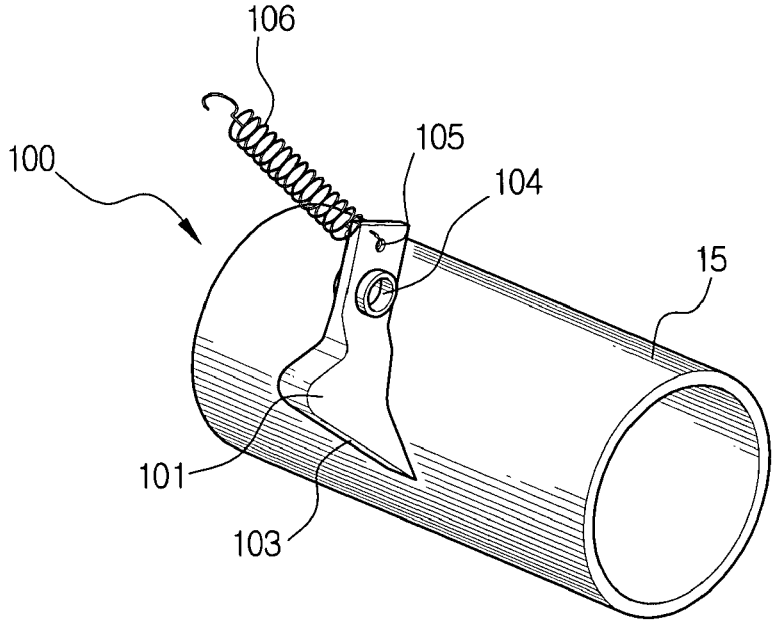
FIG. 4 is a perspective view showing the sheet separating apparatus and the heating roller of FIG. 3.

FIGS. 3 and 4 show a sheet separating apparatus 100 for a fusing unit according to an embodiment of the present invention, which includes a separating claw 101 and a contact spring 106.

The separating claw 101 is disposed toward a discharging side of a heating roller 15 to separate a sheet 10 from the heating roller 15. At this point, the separating claw 101 is pivotably assembled with a hinge 104 secured to a frame 11 and has a front end 102 constantly in contact with a surface of the heating roller 15. Also, a sheet guide surface 103 of the separating claw 101 is inclined to smoothly guide a front periphery of the sheet 10 separated by the separating claw 101 toward a sheet discharging guide 20.

Figure 2:
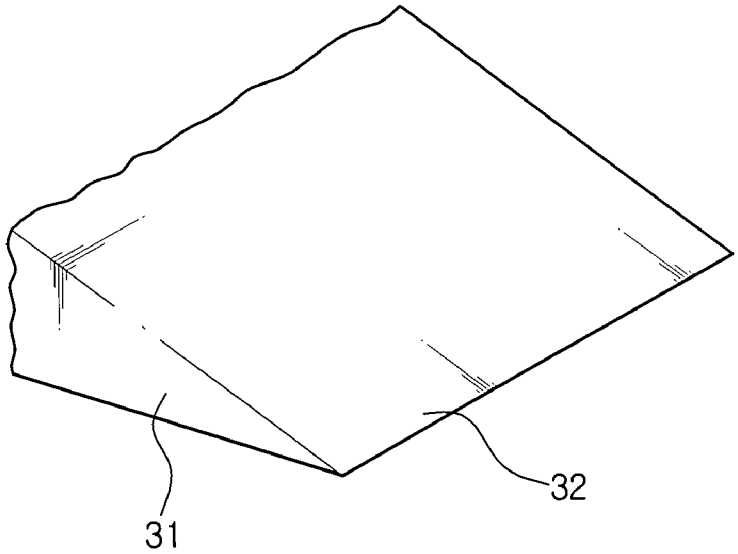
FIG. 2 (PRIOR ART)
FIG. 2 is a partial perspective view showing the front end of the separating claw of FIG. 1.
Figure 5:
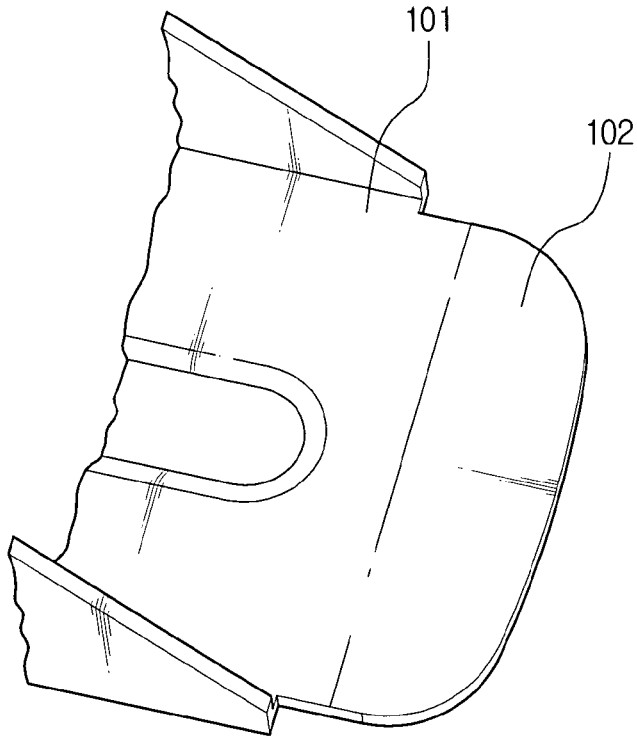
FIG. 5 is a partial perspective view showing the arc-shaped front end of the separating claw of FIG. 3.
Figure 6:
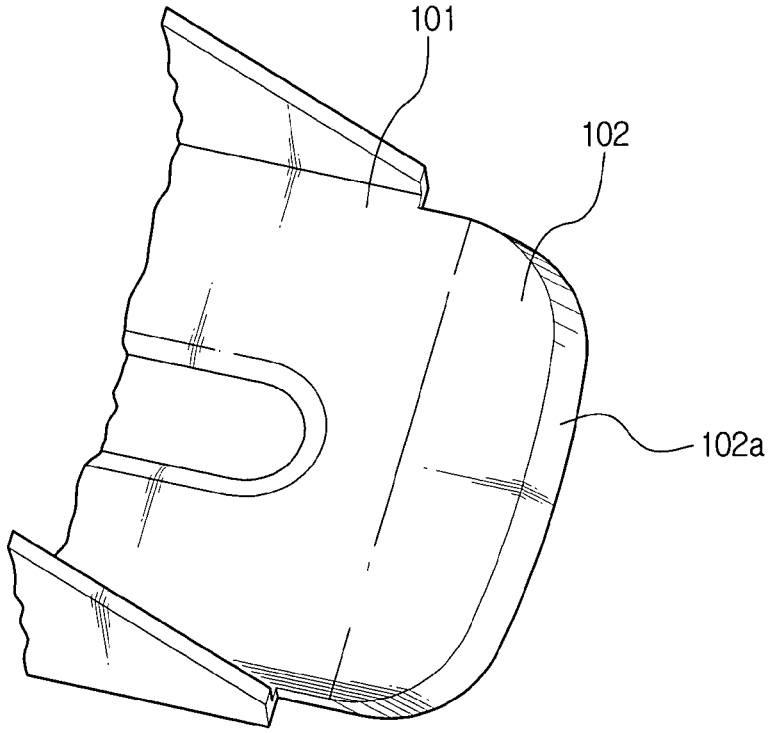
FIG. 6 is a partial perspective view showing the front end of the separating claw of FIG. 5 being chamfered.
Figure 7A:
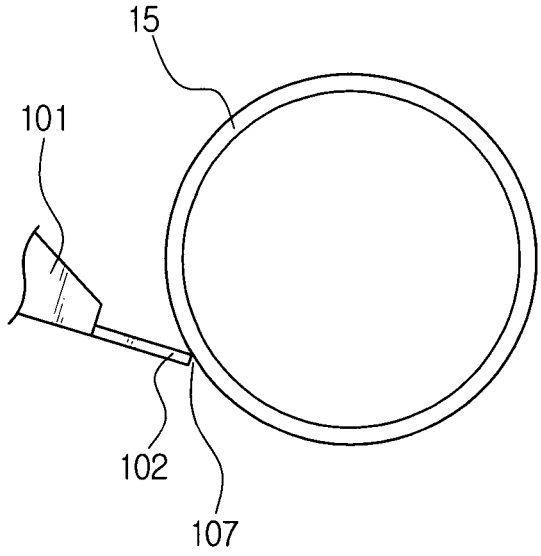
FIG. 7A is a partial cross section view showing the front end of the separating claw of FIG. 5 coming into contact with the heating roller.

The front end 102 of the separating claw 101 is shaped so that its middle portion is straightened parallel with respect to the surface of the heating roller 15 and its corners are rounded as shown in FIG. 5. In conventional separating claws in which the corners are shaped in straight lines (Refer to FIG. 2), the corners of the front end 102 cause damage to the surface of the heating roller 15 when the separating claw 101 is assembled. Also, if the separating claw 15 deviates from a parallel relationship with respect to the heating roller 15, the corners of the front end 102 cause damage to the surface of the heating roller 15. According to an embodiment of the present invention, the corners of the front end 102 of the separating claw 101 are rounded. Thus, the separating claw 101 is prevented from scratching the surface of the heating roller 101 when the separating claw 101 is assembled. Also, even if the front end 102 of the separating claw 101 deviates from a parallel relationship to the heating roller 15, because the heating roller 15 comes into contact with the rounded corner of the separating claw 101, no damage to the surface of the heating roller 15 is caused by the separating claw 101. Also, the portion of the front end 102 of the separating claw 101 which contacts the heating roller 15 is chamfered as shown in FIG. 6. The chamfered contact portion 102*a* of the front end 102 of the separating claw 101 causes the heating roller 15 to contact with a larger portion of the front end 102, and it also does not form a gap 107 generated between the front end 102 and the heating roller 15 due to the thickness of the front end 102 of the separating claw 101 (Refer to FIG. 7A). Accordingly, due to the absence of the gap 107, the sheet 10 is prevented from entering between the heating roller 15 and the front end 102 of the separating claw 101.

Also, the separating claw 101 is required to have a heat resisting property since it is constantly in contact with the heating roller 15 of a high temperature. Accordingly, the separating claw 101 is made of metallic material so as not to be deformed by heat. At this point, it is preferred that the separating claw 101 is made of a metallic plate constructed of stainless steel. The metallic separating claw 101 has a longer life span than a separating claw made of a synthetic resin since the metallic separating claw 101 has a greater heat resisting property. If synthetic resin is used as material for the separating claw 101, synthetic resin of the heat resisting property must be used, and therefore the fabricating cost is increased. Also, using synthetic resin as the material for the separating claw 101 makes it difficult to have the front end 102 of the separating claw 101 chamfered. Preferably, the metallic separating claw 101 is molded by using a press. That is, metallic material such as stainless plate is molded in a predetermined shape by blanking and bending using a press.

The sheet guide surface 103 of the separating claw 101 is provided with a low friction coating portion so as to smoothly guide the front periphery of the sheet 10 without resistance. Preferably, the coating portion is coated with Teflon.

The contact spring 106 presses the separating claw 101 so that the front end 102 is constantly in contact with the surface of the heating roller 15. One end of the contact spring 106 is secured to the frame 11 and the other end thereof is connected to the other end 105 of the separating claw 101. Accordingly, the separating claw 101 is pivoted on the hinge 104 toward the heating roller 15 so that the front end 102 of the separating claw 101 presses against the surface of the heating roller 15 with a predetermined constant pressure. The pressure of the contact spring 106 is properly set to the extent so the separating claw 101 is not separated from the heating roller 15 by a pushing force of the front periphery of a sheet of paper 10 from the heating roller 15. If the pressure of the contact spring 106 is too weak, the front periphery of the sheet 10 can enter between the heating roller 15 and the front end 102 of the separating claw 101, causing a jam. Contrarily, if the pressure of the contact spring 106 is too strong, it may interfere with the rotation of the heating roller 15 and deform the surface of the heating roller 15.

The sheet separating apparatus 100 for the fusing unit as described above is disposed between a fusing unit 12 and a discharging unit 21 as shown in FIG. 3. The fusing unit 12 is comprised of a sheet guide 13 for guiding the sheet 10 conveyed from a developing unit (not shown), and the heating roller 15 and a pressing roller 16 which apply heat and pressure to the sheet 10 to fuse a transferred image of toner onto the sheet 10. The discharging unit 21 is comprised of a pair of discharging rollers 22, 23 and a paper discharging guide 20 for guiding the sheet 10 separated from the heating roller by the sheet separating apparatus 30 to the pair of discharging rollers 22, 23. Also, the parts of the fusing unit 12 and the sheet discharging unit 21 are disposed in the frame 11.

Hereinafter, operations of the sheet separating apparatus for the fusing unit having the above structure are described with reference to FIGS. 3 to 7B.

Figure 7B:
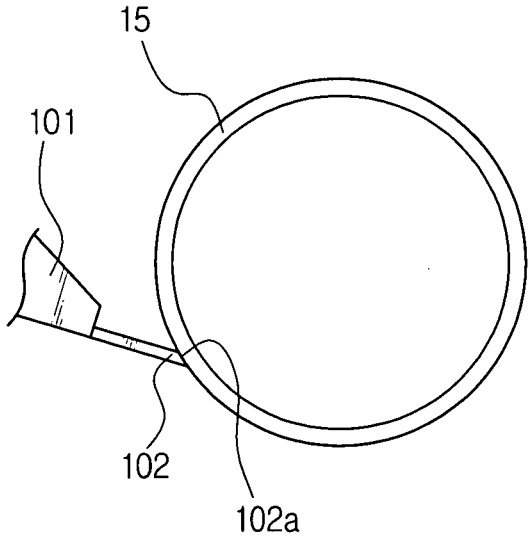
FIG. 7B is a partial cross section view showing the chamfered front end of the separating claw of FIG. 6 coming into contact with the heating roller.

The sheet 10 being conveyed from the developing unit (not shown) is conveyed along the sheet guide 13 and enters between the heating roller 15 and the pressing roller 16 of the fusing unit 12. The transferred image of the sheet 10 is fused onto the sheet 10 by the heat of the heating roller 15 and the pressure of the pressing roller 16 while the sheet 10 passes between the heating roller 15 and the pressing roller 16. At this time, the sheet 10 is inclined to roll up toward the surface of the heating roller 15 due to the toner and the heat. The front periphery of the sheet 10 conveyed along the heating roller 15 comes into contact with the separating claw 101 of the sheet separating apparatus 100. Then, the front periphery of the sheet 10 is separated from the heating roller by the separating claw 101 and continuously guided along the sheet guide surface 103 of the separating claw 101 to the sheet discharging guide 20. At this point, since the chamfered portion 102*a* of the front end 102 of the separating claw 101 is closely in contact with the heating roller 15 as shown in FIG. 7B, the sheet does not enter the gap between the front end 102 and the heating roller 15 but advances along the sheet guide surface 103. As the rotation of the heating roller 15 continues, the front periphery of the sheet 10 guided to the sheet discharging guide 20 is conveyed to the pair of discharging rollers 22, 23 along the sheet discharging guide 20. Then, the front periphery of the sheet 10 enters between the pair of discharging rollers 22, 23 and is then discharged out of the image forming apparatus.

As described above, since the sheet separating apparatus 100 for the fusing unit according to this embodiment of the present invention has the front end 102 of the separating claw 101 arc-shaped, damage to the surface of the heating roller 15 caused by the separating claw 101 can be prevented when the sheet separating apparatus 100 is installed or a jammed sheet is removed. Also, even if the separating claw 101 is deviated from a parallel relationship with respect to the heating roller 15, because the surface of the heating roller 15 is not scratched by the corners of the separating claw 101, it is easier to install the sheet separating apparatus 100. Also, since the front end 102 of the separating claw 101 has the chamfered portion so that a broader portion of the heating roller 15 contacts the separating claw 101, the sheet is efficiently prevented from entering between the front end 102 of the sheet separating claw 101 and the heating roller 15. Also, since the separating claw 101 is made of metallic material, it is easy to chamfer the front end 102 and fabrication cost is decreased.

While the invention herein disclosed has been described by means of specific embodiments and applications thereof, numerous modifications and variations can be made thereto by those skilled in the art without departing from the scope of the invention as set forth in the claims.

What is claimed is:

1. A sheet separating apparatus for a fusing unit comprising:

a separating claw rotatably disposed toward a discharging side of a heating roller for separating a sheet from the heating roller, a substantially arcuate front end of the separating claw having a top surface, a bottom surface, and rounded corners, and a chamfered contact portion that angles downwardly between the top and bottom surfaces; and a contact spring pivoting the separating claw so that the front end of the separating claw is in contact with the heating roller with a predetermined substantially constant pressure.

2. The sheet separating apparatus of claim 1, wherein the separating claw includes metallic material.

3. The sheet separating apparatus of claim 1, wherein the separating claw includes stainless steel.

4. The sheet separating apparatus of claim 1, wherein the separating claw is formed by a press.

5. A sheet separating apparatus for a fusing unit comprising:

a separating claw rotatably disposed toward a discharging side of a heating roller for separating a sheet from the heating roller, a substantially arcuate front end of the separating claw having a top surface, a bottom surface, and rounded corners, and a chamfered contact portion that extends downwardly at an angle of about 45° between the top and bottom surfaces; and a contact spring pivoting the separating claw so that the front end of the separating claw contacts the heating roller with a predetermined substantially constant pressure.

6. The sheet separating apparatus of claim 5, wherein the separating claw includes metallic material.

7. The sheet separating apparatus of claim 5, wherein the separating claw includes stainless steel.

8. The sheet separating apparatus of claim 5, wherein the separting claw is formed by a press.

* * * * *